US005142726A

United States Patent [19]

Mann

[11] Patent Number: 5,142,726

[45] Date of Patent: Sep. 1, 1992

[54] ADJUSTABLE BRISTLE LENGTH TOOTHBRUSH

[76] Inventor: Robert F. Mann, 11916 SW. Cove Rd., Vashon, Wash. 98070

[21] Appl. No.: 679,789

[22] Filed: Apr. 3, 1991

[51] Int. Cl.[5] ..... A46B 15/00

[52] U.S. Cl. ..... 15/167.1; 15/169

[58] Field of Search ..... 15/143 R, 159 R, 160, 15/106, 110, 169, 184, 296, 167.1; 128/62 A; 433/141, 142; 132/119; 119/88; D4/104–113, 130–134, 138

[56] References Cited

U.S. PATENT DOCUMENTS

| | | | |
|---|---|---|---|
| 1,303,500 | 5/1919 | Rosenberg | 15/159 R |
| 2,144,408 | 1/1939 | Holmes | 128/62 A |
| 2,613,678 | 10/1952 | Mandato | 132/119 X |
| 3,110,053 | 11/1963 | Surabian | 119/88 X |
| 3,172,139 | 3/1965 | Wire | 15/160 |
| 3,737,936 | 6/1973 | Uosaki | 15/169 |
| 3,803,663 | 4/1974 | Weihrauch | 15/169 |
| 4,149,293 | 4/1979 | Raaf et al. | 15/169 |
| 4,152,806 | 5/1979 | Raaf et al. | 15/169 |
| 4,860,692 | 8/1989 | Beard | 119/88 |

FOREIGN PATENT DOCUMENTS

| | | | |
|---|---|---|---|
| 479432 | 12/1951 | Canada | 132/119 |
| 463753 | 12/1913 | France | 15/169 |

*Primary Examiner*—Harvey C. Hornsby
*Assistant Examiner*—C. Cooley
*Attorney, Agent, or Firm*—Russell W. Illich

[57] ABSTRACT

A toothbrush with variable adjustment of operative bristle length, characterized by inclusion of an attenuate flexible pivotal appendage secured to the brush toward the handle end, extending over a depression midway along the length of the brush body. The appendage includes an aperture or a grid of holes encompassing the bristles and is positioned at the base of the bristles when the appendage is at rest, or in a retracted position. Digital pressure applied on the appendage above the depression, causes a lever action whereby the device moves perpendicularly to the bristles. A tether is provided to prevent the travel of the appendage beyond the bristle ends.

5 Claims, 1 Drawing Sheet

ADJUSTABLE BRISTLE LENGTH TOOTHBRUSH

BACKGROUND OF THE INVENTION

The need for an instrument designed for the purpose of addressing oral hygiene has long been recognized. Only recently however has the importance of removing the sticky materia alba known as plaque, especially from the gingival margin, been fully appreciated. In the case of many people, if not removed, daily plaque hardens into a calculus known as tartar, which requires professional removal, the delay of which may lead to a gum disease called gingivitis and subsequently to periodonititis, currently recognized as the leading cause of tooth loss.

Although tooth brushing alone may not provide complete prophylaxis against tooth loss, the fact remains that brushing constitutes the major portion of most people's oral hygiene regimen. Consequently, a degree of facile but functional versatility in a tooth brush may increase the quality of general care.

PRIOR ART

The potential benefit of adjustable bristle length has been realized by Helmut Raaf, Bad Schwalbach, and Oscar Heuman, in U.S. Pat. No. 4,149,293, Apr. 17, 1979, wherein is disclosed a tooth brush with a movable perforated plate, adjustable by means of a seesaw or scissor-like mechanism. The seesaw and scissor-like mechanism require a ball joint or pin to connect and provide pivotal function of the mechanism. Both embodiments would require a spring, as well, to provide resistance necessary for maintaining adjustment as desired. These embodiments, though they may be fine for many brush applications, do not adequately address the special requisites of a tooth brush.

A firm grip on the handle of the tooth brush is necessary for optimum control. During normal operation, the brush must be gripped in several different manners. By the nature of the design of the aforementioned embodiments, the adjustment is directly affected by the gripping pressure on any part of the handle. In the case of the seesaw embodiment, a firm grip on the handle would cause full travel of the perforated plate and shortest operative length of the bristles. The operator would then have to loosen his grip on the handle in order to retract the plate and extend the operative bristle length. A loss of control proportionate to the desired extension would result. In the case of the scissor-like embodiment, a firm grip on the handle would cause full retraction of the plate. Therefore, the operator would have to loosen his grip in order to raise the plate. A loss of control proportionate to the desired shortening of operative bristle length would result.

OBJECT OF THE INVENTION

It is one of the objects of this invention to provide a variable adjustable bristle length tooth brush of the utmost simplicity.

Another object of the present invention is to provide an adjustable tooth brush, the general gripping of which is independent of the adjustment mechanism.

A further object of this invention is to provide a means of preventing the travel of the variable device beyond the bristle ends.

A fourth object of the present invention is to provide a yielding function of the adjustment mechanism, to minimize potential damage to the operator's gums.

SUMMARY OF THE INVENTION

The above objectives may be achieved by a tooth brush, even with relatively soft bristles, employing an attenuate flexible, pivotal appendage. The appendage may be similar to the perimetric shape of the brush body, disposed longitudinally adjacent and positioned above the brush body. The appendage is secured to the handle and includes a depression approximately midway along the length of the brush body. The appendage also includes a head end with an aperture or grid of holes encompassing the bristles. The appendage is normally positioned at rest at the base of the bristles. Pressure applied on the appendage at a point above the depression causes a lever action, with the forward brim of the depression acting as the fulcrum, whereupon the end of the appendage encompassing the bristles moves perpendicularly to the bristles, effectually shortening and effectively stiffening the bristles. The shortening of the bristles optimizes the cleaning power of the toothbrush.

The lever action is produced by a single downward motion by a finger or digit. The midway position of the depression on the brush handle allows a person to firmly grip the end of the brush handle with the entire hand, while using a single digit (such as the index finger or thumb) to control the adjustment of the toothbrush. A means is provided for preventing the travel of the appendage beyond the bristle ends. A yielding function is provided to the appendage to cause the appendage to move back toward its retracted position when exertion of excessive force on the bristles occurs, during use of the brush. The smooth slippery nature of the bristles causes the appendage to yield, receding toward the base of the bristles. This allows the bristles to splay, thereby minimizing the likelihood of damage to the operator's gums.

DETAILED DESCRIPTION OF THE INVENTION

Figure 1:
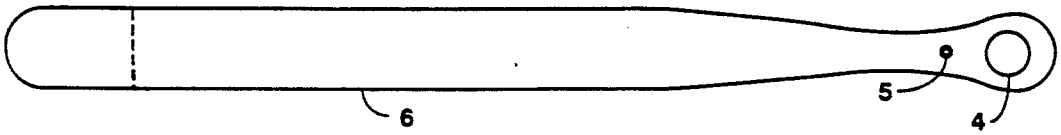
FIG. 1 is a view from above of an attenuate, flexible pivotal appendage apart from the brush body.

Referring to the drawings in detail it is seen that a toothbrush of the preferred embodiment of the present invention comprises an elongate brush body (7) of a suitable material and is preferably molded plastic of a thickness sufficient to ensure rigidity. Bristles (9), of a suitable material, preferably nylon, are fixedly connected to the head end (15) of the brush body (7). The bristles project upwardly and perpendicularly from the length of the brush body. An attenuate, flexible pivotal appendage (6), of similar material and similar in perimetric shape to the brush body (7), is disposed longitudinally adjacent above the brush body (7). A first end of the appendage is connected to the brush body toward the handle end (14). A second end of the appendage includes an aperture (4) encircling the bristles (9). The appendage is constructed of a flexible material to allow the second end to bend upwardly in response to a downwardly exerted pressure at an intermediate portion of the appendage which extends over a depression (8) located approximately midway along the length of the brush body (7). The flexible nature of the appendage (6) acts to normally bias the appendage to a retracted position where it rests against the brush body adjacent the connection of the bristles (9) and the head end (15) of the brush body.

Figure 2:
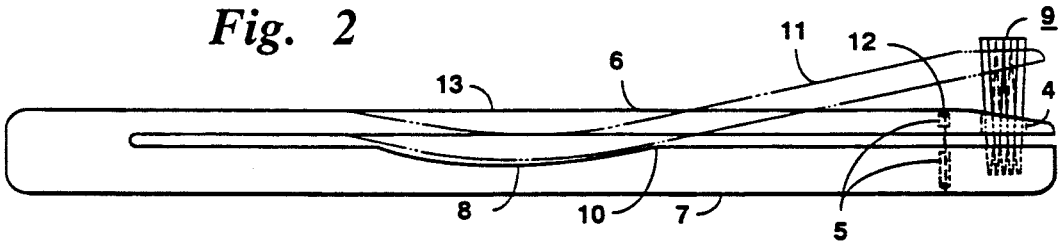
FIG. 2 is a side view of a toothbrush embodying the present invention, showing the appendage at rest and a phantom of the appendage at full travel.
Figure 3:
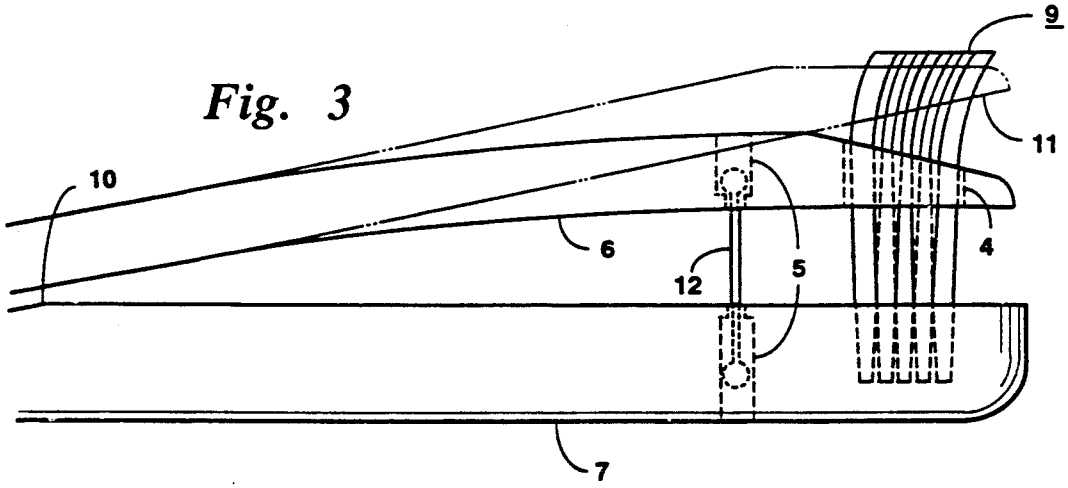
FIG. 3 is a partial side view of the forward section of a toothbrush embodying the present invention, showing the yielding function and a travel limiting provision as well as a phantom of the appendage at full travel.

Pressure applied at a point (13) on the appendage (6) above the depression (8) causes a lever action, with the forward brim (10) of the depression (8) acting as the fulcrum, whereupon the end of the appendage (6), with the aperture (4) encompassing the bristles (9) travels upward while maintaining a perpendicular attitude to the bristles (9). The phantoms (11) in FIGS. 2 and 3 illustrate the appendage (6) at full travel. A tether (12) confined to limited vertical movement in step down holes (5) in body and appendage, prevents the travel of the appendage (6) beyond the ends of the bristles (9).

The adjustability of the projection of the appendage (6) is achieved by applying varying amounts of pressure to the intermediate portion of the appendage (6) and/or varying the distance of the pressure point relative to the fulcrum or brim (10). If digital pressure is applied near the brim, the appendage will bend upwards a short distance giving the user a medium length bristle for which to brush his/her teeth. If digital pressure is applied away from the brim (10) and towards the center of the depression (8), as shown in FIG. 2, the appendage will project upwardly to its full maximum giving the user a short length bristle for brushing his/her teeth.

The appendage (6) may conceivably be molded as one piece with the brush body (7), or may be molded separately as seen in FIG. 1 and connected along line (16) in some manner such as heat bonding.

FIG. 3 illustrates the yielding function whereby excessive force on the bristles (9), during operation, causes the appendage (6) to recede toward the base of the bristles (9). The bristles (9), are flexible, smooth and slippery and fixed to the base. The appendage (6) with the aperture (4) encompassing the bristles (9), is restricted to vertical movement. Excessive pressure of the bristles (9) against a person's teeth urges the appendage (6) to yield back away from the free ends of the bristles, receding toward the base of the bristles allowing the bristles (9) to splay. The splaying of the bristles prevents the appendage from harming the gums of the user when the pressure of the bristles against the teeth goes beyond a predetermined pressure.

It should be apparent that many modifications could be made to the toothbrush which would still be encompassed within the spirit of the present invention. It is intended that all such modifications may fall within the scope of the appended claims.

What is claimed is:

1. A toothbrush comprising:

an elongated brush body having a handle end and a head end disposed opposite said handle end;

a plurality of flexible bristles extending perpendicularly to the length of said brush body, said bristles having an attachment end and a free end;

a rigid and fixed connection between said attachment end of said plurality of bristles and said head end of said brush body;

an appendage disposed longitudinally adjacent and parallel to said brush body, said appendage having a first end positioned adjacent and attached to said handle end of said brush body, a second end positioned adjacent said head end of said brush body, an intermediate portion disposed between said first and second ends, and a means for encircling said bristles at said second end of said appendage;

a means to allow said second end of said appendage to bend upwardly to a projected position in response to a downward pressure exerted at said intermediate portion of said appendage;

means to bias said second end of said appendage to an unbent position wherein said encircling means of said second end lies adjacent to said connection of said bristles to said head end of said brush body, said unbent position corresponding to a retracted position of said appendage;

said appendage bending means comprises a depression within said brush body located between said head end and said handle end of said brush body, said depression having a brim at a forward end of said depression to act as a bending fulcrum for said appendage, said intermediate portion of said appendage located above said depression to allow a portion of said appendage to contact and bend upon said brim and subsequently force said second end to said projected position;

wherein, said retracted position defines a normal length of said bristles between said free end of said bristles and said second end of said appendage for contacting a person's teeth, said projected position defines a shorter length of said bristles between said free end of said bristles and said second end of said appendage for contacting a person's teeth.

2. A toothbrush as claimed in claim 1, wherein, said first end of said appendage is rigidly attached to said handle end of said brush body.

3. A toothbrush as claimed in claim 1, wherein, said means to bias said appendage to a retracted position comprises a flexible material construction of said appendage to allow said appendage to return to a straight position alongside said brush body in the absence of a downwardly exerted pressure upon said appendage.

4. A toothbrush as claimed in claim 1, wherein, said toothbrush further comprises a means for preventing the travel of said second end of said appendage beyond said free ends of said bristles.

5. A toothbrush as claimed in claim 1, wherein, said toothbrush further comprises a means to cause said second end of said appendage to yield back away from said free ends of said bristles in response to a pressure of said bristles against a person's teeth exceeding predetermined pressure.

* * * * *